US007108004B2

(12) United States Patent
Cowie et al.

(10) Patent No.: US 7,108,004 B2
(45) Date of Patent: Sep. 19, 2006

(54) MOBILITY AIDING DEVICE

(75) Inventors: Ross Lyell Cowie, Ottawa (CA); Bjarki Hallgrimsson, Ottawa (CA)

(73) Assignee: Random Products In Trust, St. Michael (BB)

( * ) Notice: Subject to any disclaimer, the term of this patent is extended or adjusted under 35 U.S.C. 154(b) by 130 days.

(21) Appl. No.: 10/809,334

(22) Filed: Mar. 26, 2004

(65) Prior Publication Data

US 2005/0211285 A1 Sep. 29, 2005

(51) Int. Cl.
*A61H 3/04* (2006.01)

(52) U.S. Cl. ..... 135/74; 297/5

(58) Field of Classification Search ..... 297/5, 297/6; 280/242, 250.1, 242.1; 135/67, 74, 135/85, 912, 66
See application file for complete search history.

(56) References Cited

U.S. PATENT DOCUMENTS

| | | | | |
|---|---|---|---|---|
| 952,335 | A * | 3/1910 | Killian | 248/155.1 |
| 2,095,411 | A * | 10/1937 | Everest | 280/242.1 |
| 3,957,071 | A * | 5/1976 | Kenner | 135/66 |
| 4,371,183 | A | 2/1983 | Dion | 280/42 |
| 4,493,488 | A * | 1/1985 | Panaia et al. | 280/42 |
| 4,740,010 | A * | 4/1988 | Moskovitz | 280/641 |
| 4,770,432 | A * | 9/1988 | Wagner | 280/250.1 |
| 5,244,222 | A * | 9/1993 | Benoit | 280/250.1 |
| 5,380,262 | A * | 1/1995 | Austin | 482/68 |
| 5,417,472 | A * | 5/1995 | Elvinsson | 297/6 |
| 5,605,345 | A * | 2/1997 | Erfurth et al. | 280/250.1 |
| 6,135,475 | A * | 10/2000 | Brown et al. | 280/250.1 |
| 6,296,263 | B1 * | 10/2001 | Schultz et al. | 280/87.021 |
| 2002/0079663 | A1 | 6/2002 | Hallgrimsson et al. | 280/87.041 |
| 2004/0040589 | A1 * | 3/2004 | Ennals et al. | 135/67 |

* cited by examiner

*Primary Examiner*—Tamara L. Graysay
(74) *Attorney, Agent, or Firm*—Teitelbaum & MacLean; Neil Teitelbaum; Doug MacLean

(57) ABSTRACT

A mobility aiding device, such as a walker, a wheelchair, a transport chair, a shower seat or a rollator, are used in providing support to injured or ailing persons during activity or movement. A solid two-piece seating platform is provided with a structural support for distributing the weight of the user to the frame. Furthermore, the two pieces of the seating platform are inter-hinged, enabling the entire device to fold up into a storage position. A lock is provided for maintaining the structural support in place, and a handle is provided for facilitating folding the device into the storage position.

19 Claims, 9 Drawing Sheets

MOBILITY AIDING DEVICE

CROSS-REFERENCE TO RELATED APPLICATIONS

The present application does not claim priority.

TECHNICAL FIELD

The present invention relates to a mobility aiding device, and in particular to a wheelchair, a walker, a transport chair, a shower seat or a rollator with a solid seat, which is hinged in the middle to enable the device to be easily folded into a storage position.

BACKGROUND OF THE INVENTION

A large, aging, urban population has created a demand for various mobility aiding devices, such as wheelchairs, walkers, transport chairs, shower seats and rollators, which facilitate actions and movements in their daily lives without requiring additional assistance, to ensure a certain degree of independence. Walkers, transport chairs, shower seats and rollators (walkers with wheels) have become more popular than wheelchairs, crutches or canes as mobility aids for people with sore legs, hips or backs, because of their added structural support and their versatility. Present day rollators, such as the one disclosed in U.S. patent application Ser. No. 2002/0079663 filed Jul. 18, 2001 in the name of Hallgrimsson et al, come complete with brakes, a seat and a storage basket. Another feature highly sought after in mobility aids is their ability to fold up into a storage position for travel or simply to save space when not in use. Conventional wheel chairs have long since disclosed the ability to fold two sides of a frame into a storage position; however these devices have always had a flexible or hammock seat. Hard platforms are now desired to provide more comfortable seating and a useable supporting surface for other items. Complicated, one piece seats have been disclosed in U.S. Pat. Nos. 4,371,183; 4,493,488; and 5,605,345. Unfortunately, these devices require a great deal of manual dexterity and strength to open and close. Accordingly, two-piece seats have been developed, such as the ones disclosed in U.S. Pat. No. 4,770,432 issued Sep. 13, 1988 in the name of Kenneth Wagner; U.S. Pat. No. 5,244,222 issued Sep. 14, 1993 to Robert Benoit; and U.S. Pat. No. 6,135,475 issued Oct. 24, 2000 to Richard Brown et al. These devices either require extra support panels that must be accessed from below the seat, as in the Wagner device, or rely on an extra wide abutting surfaces between the pivoting seat panels, as in the Benoit and Brown et al devices. Unfortunately, the extra wide abutting surfaces do not always provide sufficient strength for long term use. Moreover, the abutting surfaces can pinch body parts or items therebetween causing damage or pain.

An object of the present invention is to overcome the shortcomings of the prior art by providing a mobility aid, such as a wheelchair, transport chair, walker, shower seat or rollator, with a solid seating platform made up or two pivotally connected sections, with structural reinforcements, that fold up easily into a storage position.

SUMMARY OF THE INVENTION

Accordingly, the present invention relates to a mobility aiding device adjustable between a use and a storage position comprising:

a first frame member having a pair of ground engaging means at a lower end thereof;

a second frame member having a pair of ground engaging means at a lower end thereof;

a first support pivotally connected to the first frame member;

a second support pivotally connected to the second frame member and pivotally connected to the first support, the first and second supports for supporting a weight above the ground in the use position;

hinge means pivotally connecting the first support to the second support enabling the first and second supports to pivot towards each other into the storage position; and tension rod means for distributing the weight between the first and second supports, said tension rod means being adjustable between an extended position in which said tension rod structurally interconnects said first and second supports, when the device is in the use position, and a released position enabling the device to be adjusted to the storage position.

Another aspect of the present invention relates to a mobility aiding device adjustable between a use and a storage position comprising:

a first frame member having a pair of ground engaging means at a lower end thereof;

a second frame member having a pair of ground engaging means at a lower end thereof;

a first support pivotally connected to the first frame member;

a second support pivotally connected to the second frame member and pivotally connected to the first support, the first and second supports for supporting a weight above the ground in the use position;

first hinge means pivotally connecting upper portions of the first and second supports enabling the first and second supports to pivot towards each other into the storage position, while preventing any pinching action of the first and second supports during entry into the use position;

first and second link means pivotally connected to lower portions of the first and second supports, respectively, for distributing the weight to the first and second frame members, while in the use position; and second hinge means pivotally connecting the first and second link means, the second hinge means disposed parallel to the first hinge means, enabling the first and second link means to pivot towards each into the storage position.

BRIEF DESCRIPTION OF THE DRAWINGS

The invention will be described in greater detail with reference to the accompanying drawings which represent preferred embodiments thereof, wherein.

DETAILED DESCRIPTION

Figure 1:
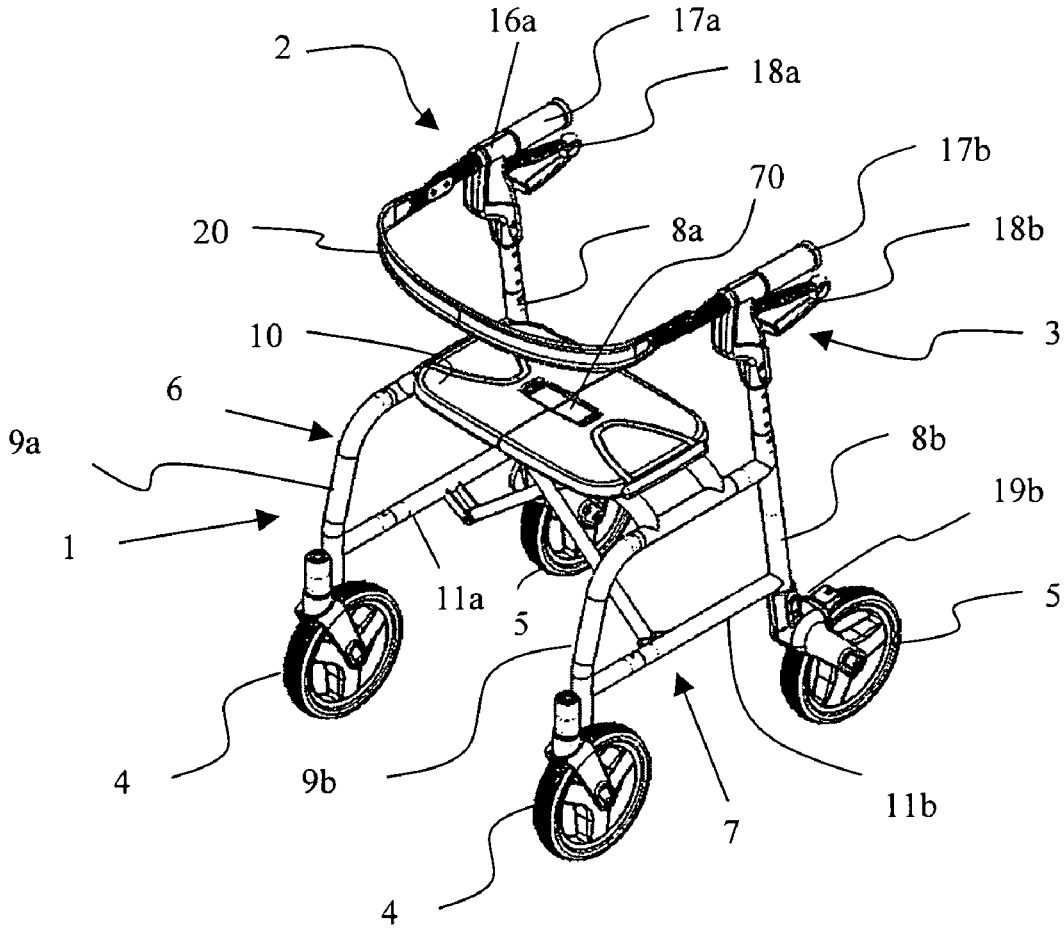
FIG. 1 is an isometric view of the rollator according to the present invention in a use position.

With reference to FIGS. 1 to 4, the rollator according to the present invention includes a chassis, generally indicated at 1, with handles 2 and 3 extending upwardly therefrom for grasping by the user, and with front and rear wheels 4 and 5, respectively, extending downwardly therefrom for engaging the ground. The chassis 1 includes a right side frame 6 and a left side frame 7.

The right side frame 6 is comprised of an upright 8*a*, an L-shaped bar 9*a* and a cross bar 11*a* extending therebetween. Similarly, the left side frame 7 is comprised on an upright 8*b*, an L-shaped bar 9*b* and a cross bar 11*b*. A seating structure 10 extends between the right side frame 6 and the left side frame 7. The chassis 1 is preferably made up of a lightweight high-strength material, such as aluminum.

Handles 2 and 3 are mounted on the ends of uptight 8*a* and 8*b*, respectively, and include a mounting bracket 16*a* and 16*b*, a hand grip 17*a* and 17*b*, and a brake lever 18*a* and 18*b*, respectively. Each brake lever 18*a* and 18*b* is connected to a brake linkage (not shown) extending down through the uprights 8*a* and 8*b* to pivoting brake pads 19*a* and 19*b* mounted proximate rear wheels 5. As disclosed in Published U.S. patent application Ser. No. 2002/50697, which is incorporated herein by reference, upward actuation on the brake levers 18*a* and 18*b* results in a temporary braking action, while downward actuation of the braking levers 18*a* and 18*b* results in a parking brake action. A backrest strap 20 extends from the mounting bracket 16*a* to the mounting bracket 16*b* providing back support for an individual seated on the seating structure 10 and facing rearwardly. Also as disclosed in the aforementioned United States Patent Application, the backrest strap 20 is pivotally mounted to the mounting brackets 16*a* and 16*b* enabling the position of the backrest strap 20 to be reversed providing back support for a seated individual facing frontwardly.

Rear wheel brackets 21*a* and 21*b* are mounted on the lower ends of the uprights 8*a* and 8*b*, respectively, for rotatably supporting the rear wheels 5 and the brake pads 19*a* and 19*b*. Front wheel brackets 22*a* and 22*b* are mounted on the lower end of the L-shaped bars 9*a* and 9*b*, respectively, for rotatably supporting the front wheels 4. If the present invention were to be used with a walker or shower seat, the front and rear wheels 4 and 5 could be replaced by end caps made or rubber or some other non-slip material. Moreover, if the present invention were to be used in a wheelchair, the rear wheels 5 would be replaced with larger wheels enabling manual rotation by the seated individual, as is well known in the art. In a transport chair, the backrest strap 20 would be replaced by a solid back rest.

Figure 2:
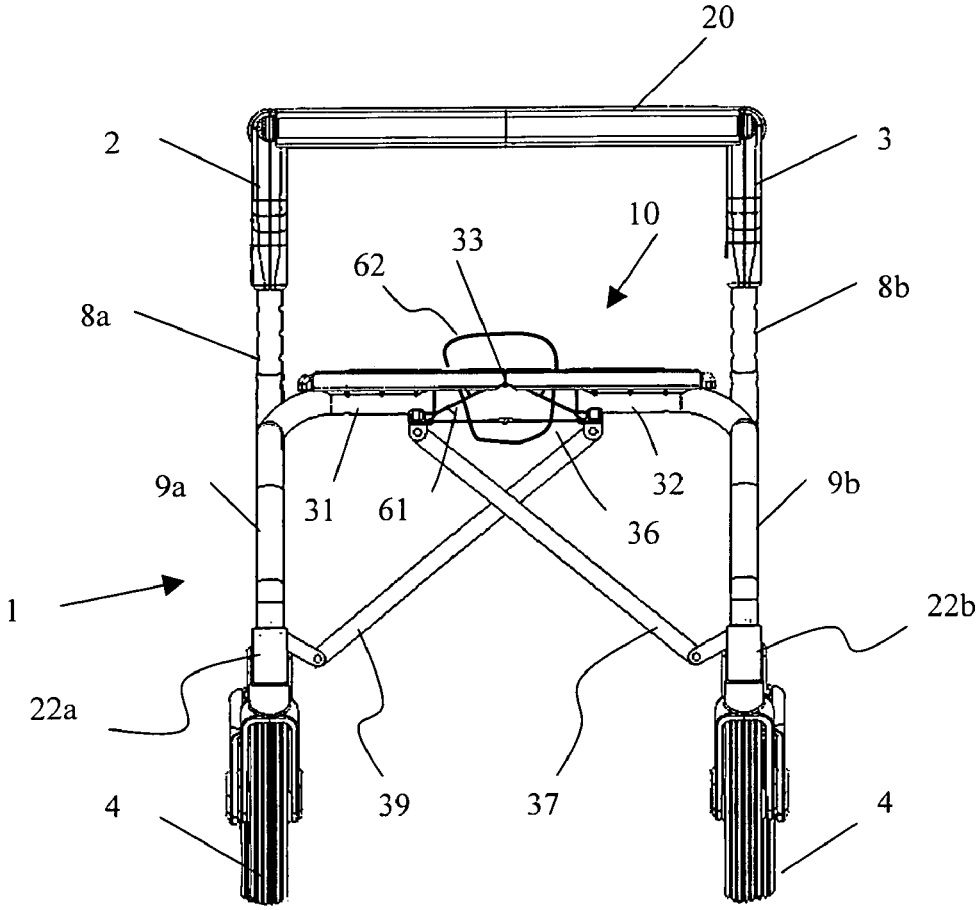
FIG. 2 is a front view of the rollator of FIG. 1.
Figure 3:
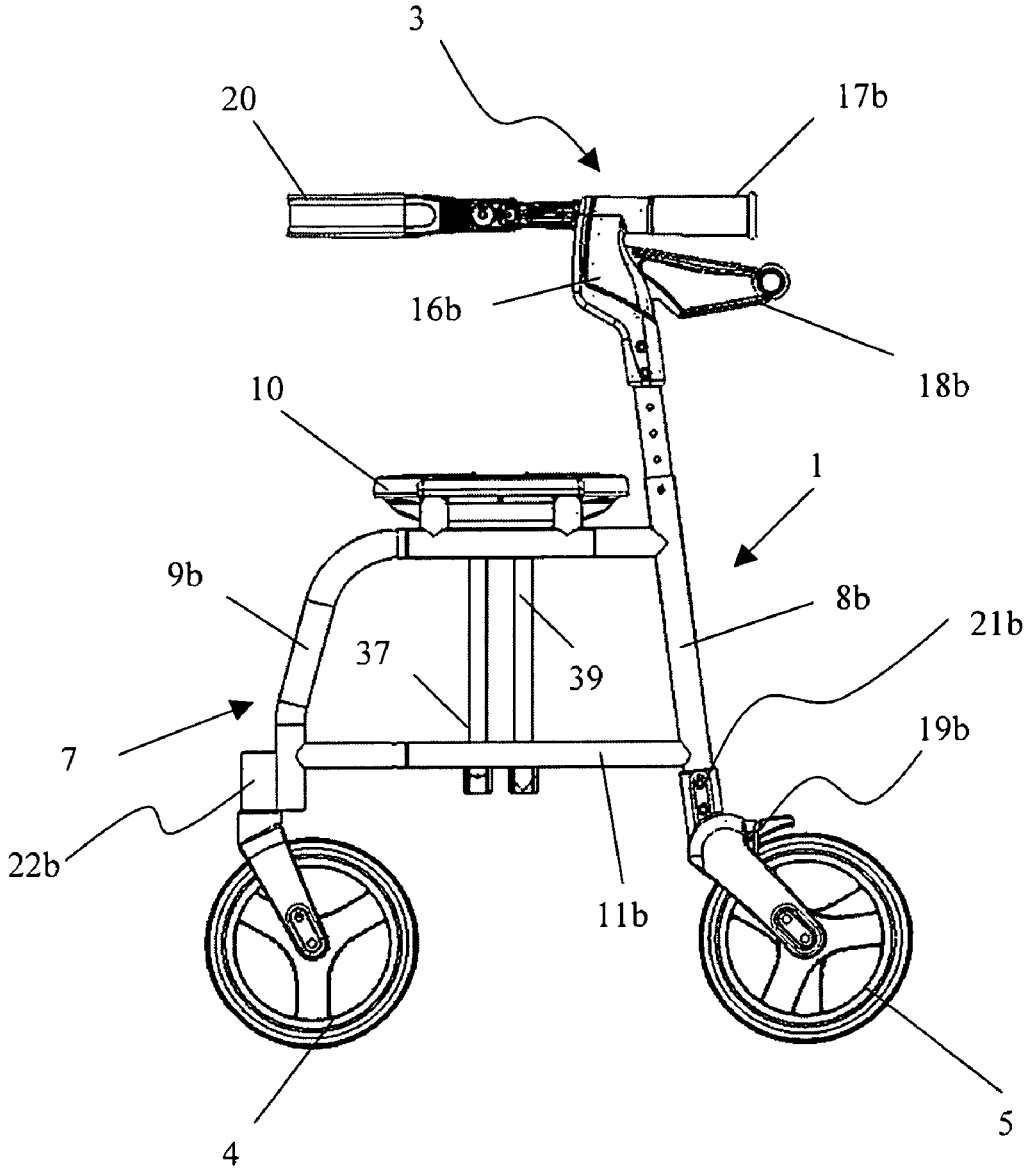
FIG. 3 is a side view of the rollator of FIGS. 1 and 2.
Figure 4:
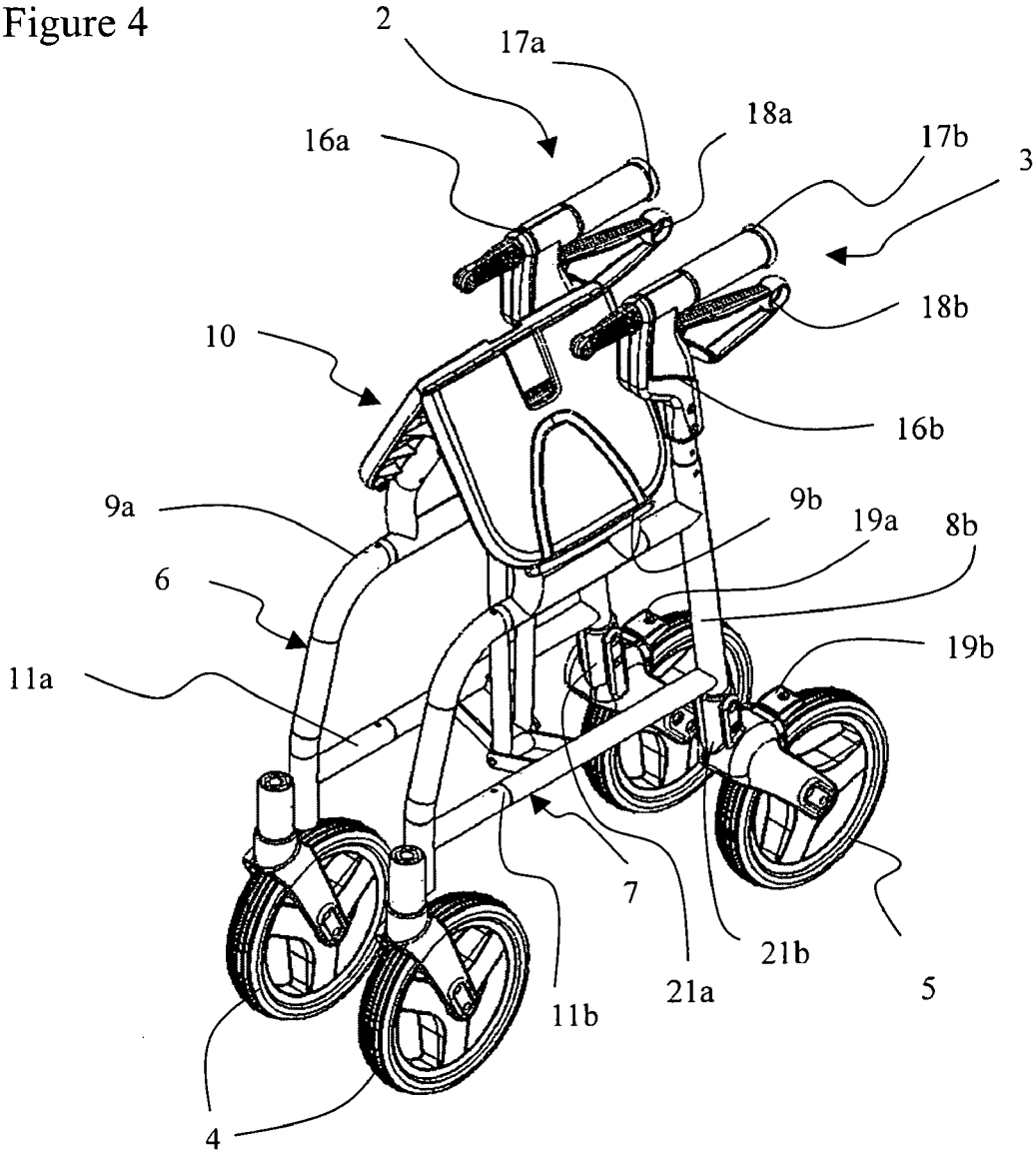
FIG. 4 is an isometric view of the rollator of FIG. 1 in the storage position.
Figure 5:
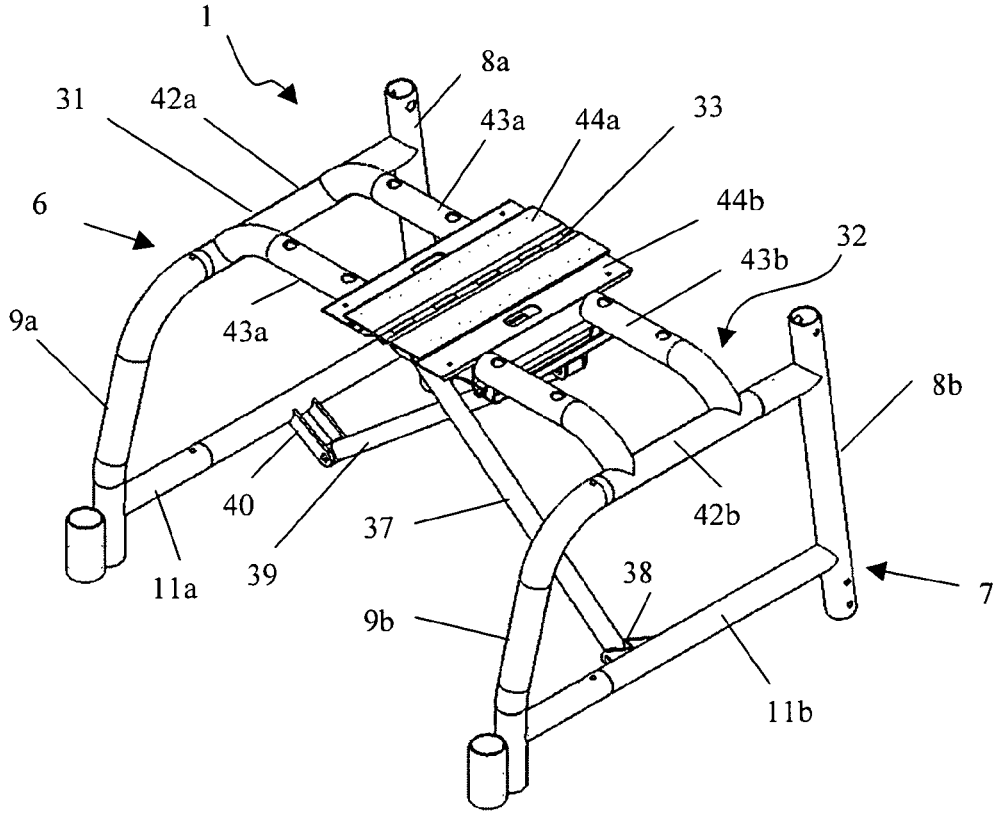
FIG. 5 is an isometric view of the chassis of the rollator of FIGS. 1 to 4.
Figure 6:
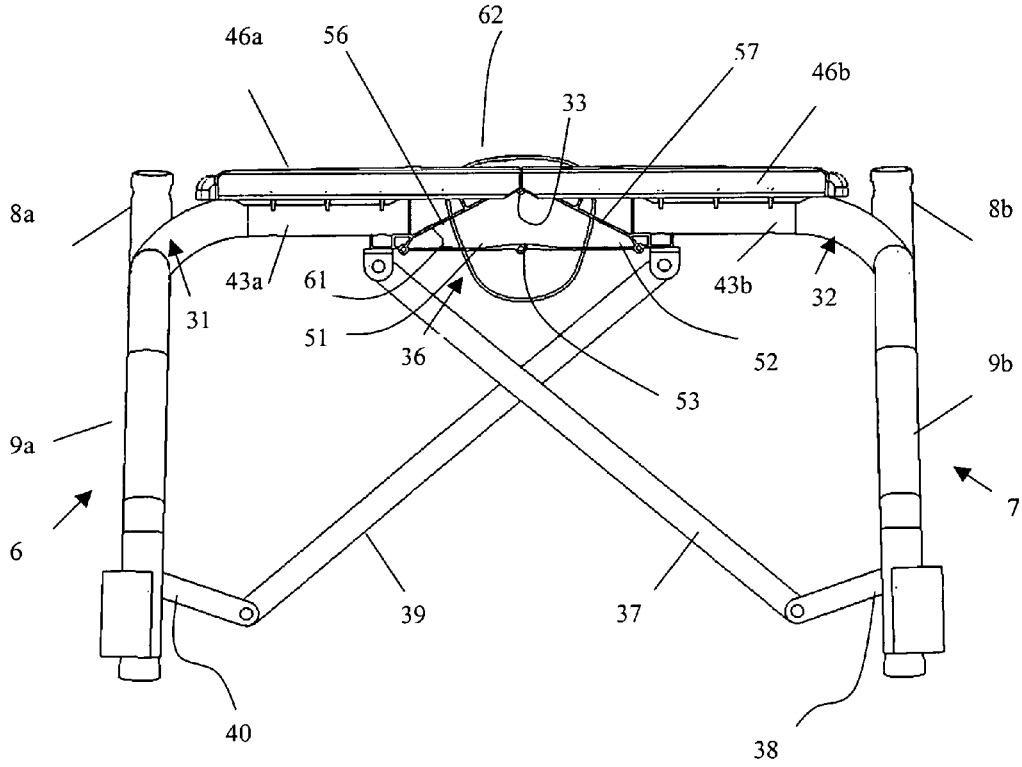
FIG. 6 is a front view of the chassis of FIG. 5.

FIGS. 1 to 3 illustrate the rollator in the use position, while FIG. 4 illustrates the storage position.

With reference to FIGS. 5 to 9, the seating structure 10 includes a right side support 31 rotatably mounted on the L-shaped bar 9*a*, and a left side support 32 rotatably mounted on the L-shaped bar 9*b*. The right side and left side supports 31 and 32 are pivotally interconnected by a hinge 33 extending along the top surface of the right side and left side supports 31 and 32, and a hinged link, in the form of a tension-rod plate 36, pivotally interconnecting the bottom surfaces of the right and left side supports 31 and 32. Positioning the hinge 33 on the top surfaces of the right and left side supports 31 and 32 prevents the ride and left side supports 31 and 32 from pinching anyone or anything, while the seating structure 10 is rotated into the use position. Additional support for the seating structure 10 is provided by a first cross brace 37 extending from the bottom surface of the right side support platform 31 to a first finger bracket 38 fixed to the cross bar 11*b*, and a second cross brace 39 extending from the bottom surface of the left side support platform 32 to a second finger bracket 40 fixed to the cross bar 11*a*. Both ends of the first and second cross braces 37 and 39 are pivotally connected to their respective mounting points.

The right side support 31 includes a sleeve 42*a* surrounding the horizontal portion of the L-shaped bar 9*a*, and a pair of J-shaped arms 43*a* extending therefrom for supporting a flat seating platform 44*a*. Similarly, the left side support 32 includes a sleeve 42*b* surrounding the horizontal portion of the L-shaped bar 9*b*, and pair of J-shaped arms 43*b* extending therefrom for supporting a flat seating platform 44*b*. A foam seat cover is placed over the flat seating platforms 44*a* and 44*b* covering the hinge 33. The seat cover can be made from two separate pieces 46*a* and 46*b* or from a single piece of foam-like material with a particularly flexible section covering the hinge 33. The flexible section could include several grooves extending thereacross to provide the required flexibility. Since the seat cover pieces 45*a* and 46*b* are made of foam, any accidental pinching therebetween will not result in any pain.

Figure 7:
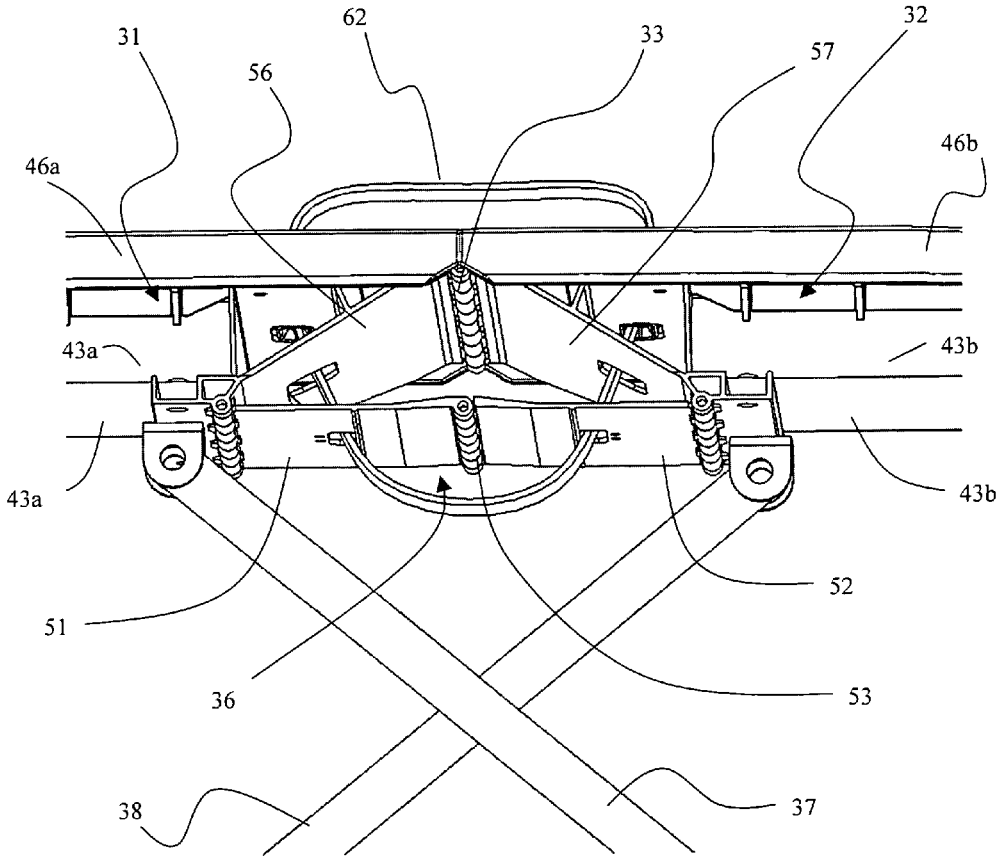
FIG. 7 is an end view of the chassis of FIGS. 5 and 6 looking up from below the seating platform.

As best seen in FIG. 7, the tension-rod plate 36 is comprised of a first solid link 51 pivotally connected to the bottom surfaces of J-shaped arms 43*a*, and a second solid link 52 pivotally connected to the bottom surfaces of J-shaped arms 43*b*. The first and second solid links 51 and 52 are pivotally interconnected by a hinge 53, which is positioned directly below the first hinge 33 and parallel thereto.

Force-transmitting webs or struts 56 and 57 extend diagonally downward from either side of the hinge 33 to proximate the ends of the first and second solid links 51 and 52, respectively, for transferring the force generated by an individual or an item sitting on the flat seating platforms 44*a* and 44*b* to the arms 43*a* and 43*b* and to the cross braces 37 and 39. In use, the tension-rod plate 36 is placed in tension by the aforementioned force and holds the bottom surfaces of the right and left side supports 31 and 32 together, while the hinge 33 keeps the upper surfaces together. A locking feature 61 holds the first and second solid links 51 and 52 in the extended position, shown in FIGS. 5 to 7, and prevents the first and second solid links 51 and 52 from folding downwardly causing unwanted collapse of the seat 46 during movement over uneven ground. In the illustrated embodiment, the locking feature 61 comprises a spring clip extending from the first solid link 51 and the force transmitting strut 56; however, other locking features are possible including a specially designed hinge, which prevents rotation past the fully opened position (illustrated in FIG. 6).

Figure 8:
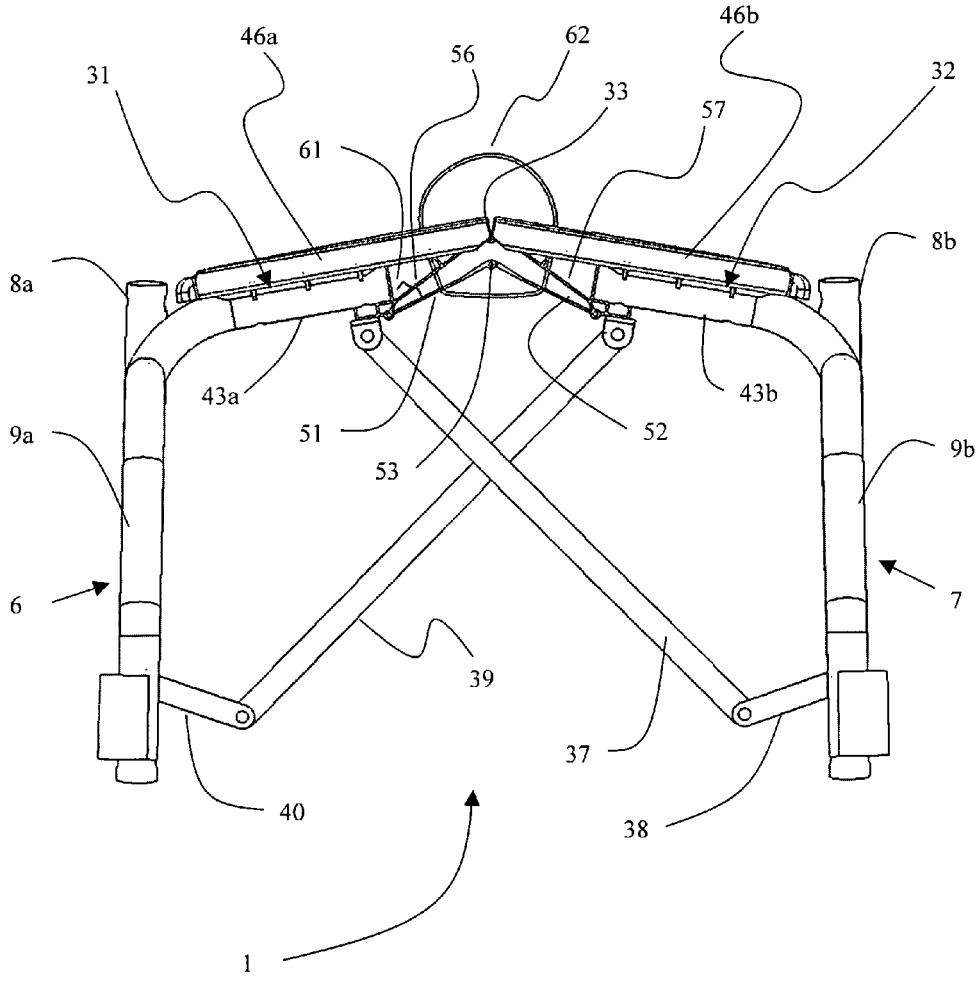
FIG. 8 is an end view of the chassis of FIGS. 5 to 7 in a partially collapsed position.
Figure 9:
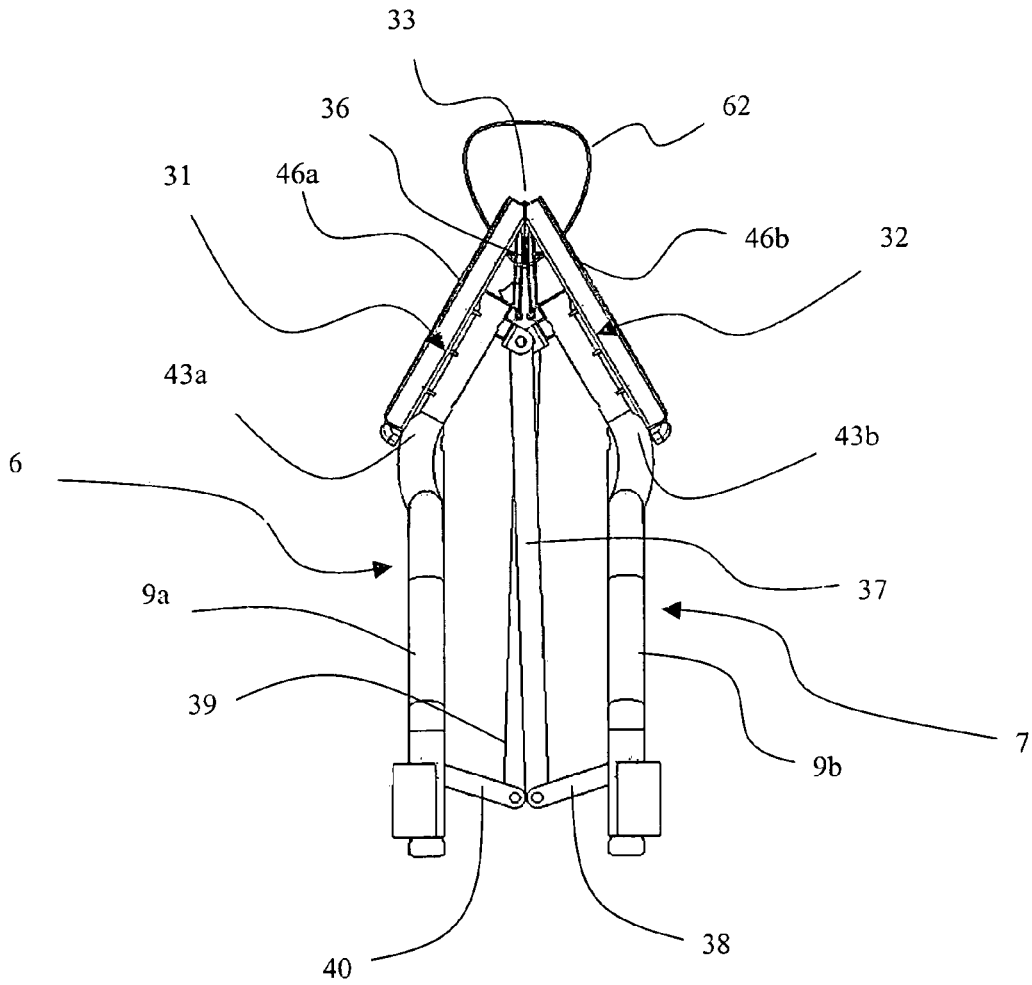
FIG. 9 is an end view of the chassis of the rollator of FIGS. 5 to 8 in the storage position.

With reference to FIGS. 6 to 9, a handle, in the form of a strap 62, which extends through openings in the first and second solid links 51 and 52, the struts 56 and 57, and the seat covers 46*a* and 46*b*, is used to manually pull up on the tension-rod plate 36, which pivots the first and second solid links 51 and 52 towards each other, and pivots the seat covers 46*a* and 46*b* towards each other (see FIG. 8). Initial force pulling up on the strap 62 disengages the locking feature 61 and pivots the tension-rod plate 36, enabling the right and left supports 31 and 32 to pivot towards each other. Continued force pulling up on the strap 62 lifts the chassis 1 just off the ground, which folds the right and left side supports 31 and 32 towards each other, enabling the right and left side frames 6 and 7 to move closer together in the storage position (FIG. 9). The strap 62 then acts as a useful handle for carrying the rollator device. Each flat seating platform 44*a* and 44*b* includes a shallow recess 70 (FIG. 1) in the seat covers 46*a* and 46*b* for receiving the strap 62 to ensure the strap 62 does not cause discomfort to anyone sitting on the seating structure 10.

We claim:

1. A mobility aiding device adjustable between a use and a storage position comprising:

a first frame member having a pair of ground engaging means at a lower end thereof for engaging ground thereunder;

a second frame member having a pair of ground engaging means at a lower end thereof for engaging the ground;

a first support pivotally connected to the first frame member;

a second support pivotally connected to the second frame member and pivotally connected to the first support, the first and second supports for supporting a weight above the ground in the use position;

hinge means pivotally connecting a top of the first support to a top of the second support enabling the first and second supports to pivot towards each other into the storage position; and tension rod means extending between a bottom of the first support and a bottom of the second support for distributing the weight between the first and second supports, said tension rod means being adjustable between an extended position in which said tension rod structurally interconnects said first and second supports, when the device is in the use position, and a released position enabling the device to be adjusted to the storage position.

2. The device according to claim 1, further comprising strut means for transferring the weight from the hinge means to the tension rod means.

3. The device according to claim 1, further comprising locking means for maintaining the tension rod means in the extended position.

4. The device according to claim 3, wherein the locking means comprises a spring clip biasing the tension rod means in the extended position.

5. The device according to claim 1, further comprising a handle extending through said first support for pivoting said tension rod means into the release position and said first and second supports into the storage position.

6. The device according to claim 5, wherein said tension rod means includes: a first link pivotally connected to said first support, and a second link pivotally connected to said second support and said first link.

7. The device according to claim 6, wherein said handle extends from said first link through said first support, back through said second support to said second link, whereby pulling on said handle pivots said first and second links and said first and second supports towards each other into the storage position.

8. The device according to claim 1, wherein said tension rod means includes:

a first link pivotally connected to said first support, and a second link pivotally connected to said second support and said first link.

9. The device according to claim 1, further comprising a first cross brace extending between the first support and the second frame member for transferring at least a portion of the weight to the second frame member; and a second cross brace extending between the second support and the first frame member for transferring at least a portion of the weight to the first frame member.

10. A mobility aiding device adjustable between a use and a storage position comprising:

a first frame member having a pair of ground engaging means at a lower end thereof for engaging ground thereunder;

a second frame member having a pair of ground engaging means at a lower end thereof for engaging the ground;

a first support pivotally connected to the first frame member;

a second support pivotally connected to the second frame member and pivotally connected to the first support, the first and second supports for supporting a weight above the ground in the use position;

hinge means pivotally connecting the first support to the second support enabling the first and second supports to pivot towards each other into the storage position;

tension rod means for distributing the weight between the first and second supports, said tension rod means being adjustable between an extended position in which said tension rod structurally interconnects said first and second supports, when the device is in the use position, and a released position enabling the device to be adjusted to the storage position;

a first cross brace extending between the first support and the second frame member for transferring at least a portion of the weight to the second frame member; and a second cross brace extending between the second support and the first frame member for transferring at least a portion of the weight to the first frame member.

11. A mobility aiding device adjustable between a use and a storage position comprising:

a first frame member having a pair of ground engaging means at a lower end thereof for engaging ground thereunder;

a second frame member having a pair of ground engaging means at a lower end thereof for engaging the ground;

a first support pivotally connected to the first frame member;

a second support pivotally connected to the second frame member and pivotally connected to the first support, the first and second supports for supporting a weight above the ground in the use position;

hinge means pivotally connecting the first support to the second support enabling the first and second supports to pivot towards each other into the storage position;

tension rod means for distributing the weight between the first and second supports, said tension rod means being adjustable between an extended position in which said tension rod structurally interconnects said first and second supports, when the device is in the use position, and a released position enabling the device to be adjusted to the storage position; and a locking feature for maintaining the tension rod means in the extended position wherein said locking feature comprises a spring clip biasing the tension rod in the extended position.

12. A mobility aiding device adjustable between a use and a storage position comprising:

a first frame member having a pair of ground engaging means at a lower end thereof for engaging ground thereunder;

a second frame member having a pair of ground engaging means at a lower end thereof for engaging the ground;

a first support pivotally connected to the first frame member;

a second support pivotally connected to the second frame member and pivotally connected to the first support, the first and second supports for supporting a weight above the ground in the use position;

hinge means pivotally connecting the first support to the second support enabling the first and second supports to pivot towards each other into the storage position;

tension rod means for distributing the weight between the first and second supports, said tension rod means being adjustable between an extended position in which said tension rod structurally interconnects said first and second supports, when the device is in the use position, and a released position enabling the device to be adjusted to the storage position; and a handle extending through said first support for pivoting said tension rod into the release position, and for pivoting said first and second supports into the storage position.

13. The device according to claim 12, wherein said tension rod means includes:

a first link pivotally connected to said first support, and a second link pivotally connected to said second support and said first link.

14. The device according to claim 13, wherein said handle extends from said first link through said first support, back through said second support to said second link, whereby pulling on said handle pivots said first and second links towards each other and said first and second supports towards each other into the storage position.

15. A mobility aiding device adjustable between a use and a storage position comprising:

a first frame member having a pair of ground engaging means at a lower end thereof;

a second frame member having a pair of ground engaging means at a lower end thereof;

a first support pivotally connected to the first frame member;

a second support pivotally connected to the second frame member and pivotally connected to the first support, the first and second supports for supporting a weight above the ground in the use position;

first hinge means pivotally connecting upper portions of the first and second supports enabling the first and second supports to pivot towards each other into the storage position, while preventing any pinching action of the first and second supports during entry into the use position;

first and second link means pivotally connected to lower portions of the first and second supports, respectively, for distributing the weight to the first and second frame members, while in the use position;

second hinge means pivotally connecting the first and second link means, the second hinge means disposed parallel to the first hinge means, enabling the first and second link means to pivot towards each other into the storage position; and a first strut for transferring a portion of the weight from the first hinge means to the first link means, and a second strut for transferring a portion of the weight from the second hinge means to the second link means.

16. A mobility aiding device adjustable between a use and a storage position comprising:

a first frame member having a pair of ground engaging means at a lower end thereof;

a second frame member having a pair of ground engaging means at a lower end thereof;

a first support pivotally connected to the first frame member;

a second support pivotally connected to the second frame member and pivotally connected to the first support, the first and second supports for supporting a weight above the ground in the use position;

first hinge means pivotally connecting upper portions of the first and second supports enabling the first and second supports to pivot towards each other into the storage position, while preventing any pinching action of the first and second supports during entry into the use position;

first and second link means pivotally connected to lower portions of the first and second supports, respectively, for distributing the weight to the first and second frame members, while in the use position;

second hinge means pivotally connecting the first and second link means, the second hinge means disposed parallel to the first hinge means, enabling the first and second link means to pivot towards each other into the storage position; and a handle means extending through said first support for pivoting said first and second supports into the storage position.

17. The device according to claim 16, wherein said handle extends from said first link, said first support, back through said second support to said second solid link, whereby pulling on said handle pivots said first and second links towards each other and said first and second supports towards each other into the storage position.

18. A mobility aiding device adjustable between a use and a storage position comprising:

a first frame member having a pair of ground engaging means at a lower end thereof;

a second frame member having a pair of ground engaging means at a lower end thereof;

a first support pivotally connected to the first frame member;

a second support pivotally connected to the second frame member and pivotally connected to the first support, the first and second supports for supporting a weight above the ground in the use position;

first hinge means pivotally connecting upper portions of the first and second supports enabling the first and second supports to pivot towards each other into the storage position, while preventing any pinching action of the first and second supports during entry into the use position;

first and second link means pivotally connected to lower portions of the first and second supports, respectively, for distributing the weight to the first and second frame members, while in the use position;

second hinge means pivotally connecting the first and second link means, the second hinge means disposed parallel to the first hinge means, enabling the first and second link means to pivot towards each other into the storage position; and locking means for maintaining the first and second links in the extended position.

19. A mobility aiding device adjustable between a use and a storage position comprising:

a first frame member having a pair of ground engaging means at a lower end thereof;

a second frame member having a pair of ground engaging means at a lower end thereof;

a first support pivotally connected to the first frame member;

a second support pivotally connected to the second frame member and pivotally connected to the first support, the first and second supports for supporting a weight above the ground in the use position;

first hinge means pivotally connecting upper portions of the first and second supports enabling the first and second supports to pivot towards each other into the storage position, while preventing any pinching action of the first and second supports during entry into the use position;

first and second link means pivotally connected to lower portions of the first and second supports, respectively, for distributing the weight to the first and second frame members, while in the use position;

second hinge means pivotally connecting the first and second link means, the second hinge means disposed parallel to the first hinge means, enabling the first and second link means to pivot towards each other into the storage position; and a first cross brace extending between the first support and the second frame member for transferring at least a portion of the weight to the second frame member; and a second cross brace extending between the second support and the first frame member for transferring at least a portion of the weight to the first frame member.

* * * * *